US009576716B2

(12) United States Patent
Edwards et al.

(10) Patent No.: US 9,576,716 B2
(45) Date of Patent: Feb. 21, 2017

(54) COMMON MODE CHOKE AND INTEGRATED CONNECTOR MODULE AUTOMATION OPTIMIZATION

(71) Applicant: Cisco Technology, Inc., San Jose, CA (US)

(72) Inventors: William F. Edwards, Livermore, CA (US); George Edward Curtis, San Jose, CA (US); Ki Yuen Chau, Palo Alto, CA (US); Sandeep Arvindkumar Patel, Los Gatos, CA (US); Keith Frank Tharp, San Jose, CA (US); Robin Carol Johnson, Boulder Creek, CA (US); Yu Liu, Pleasanton, CA (US); Billie Alton Hudson, Sadler, TX (US)

(73) Assignee: CISCO TECHNOLOGY, INC, San Jose, CA (US)

( * ) Notice: Subject to any disclaimer, the term of this patent is extended or adjusted under 35 U.S.C. 154(b) by 303 days.

(21) Appl. No.: 14/140,421

(22) Filed: Dec. 24, 2013

(65) Prior Publication Data

US 2015/0179328 A1 Jun. 25, 2015

(51) Int. Cl.
*H01F 27/02* (2006.01)
*H01F 27/28* (2006.01)
(Continued)

(52) U.S. Cl.
CPC ..... *H01F 27/04* (2013.01); *H01F 17/062* (2013.01); *H01F 27/027* (2013.01); *H01F 27/06* (2013.01);
(Continued)

(58) Field of Classification Search
USPC ..... 336/229, 192
See application file for complete search history.

(56) References Cited

U.S. PATENT DOCUMENTS 6,395,983 B1 * 5/2002 Gutierrez ..... H01L 23/057 174/551
7,241,181 B2 7/2007 Machado et al.
(Continued)

FOREIGN PATENT DOCUMENTS

GB 2197544 A * 5/1988 ..... H01F 27/324
JP 2006222223 A 8/2006
JP 2007227660 A 9/2007

OTHER PUBLICATIONS

International Search Report and Written Opinion for International Application No. PCT/US2014/071308, mailed Jul. 16, 2015.
(Continued)

*Primary Examiner* — Elvin G Enad
*Assistant Examiner* — Ronald Hinson
(74) *Attorney, Agent, or Firm* — Polsinelli PC

(57) ABSTRACT

The subject disclosure relates improved common mode choke (CMC) and integrated connector module (ICM) designs for Ethernet applications. Some aspects provide an improved CMC component, including an upper chassis element having a first plurality of comb structures vertically protruding from an edge of the upper chassis element, and a lower chassis element comprising a second plurality of comb structures vertically protruding from an edge of the lower chassis element, the second plurality of comb structures configured to interlock with the first plurality of comb structures to form an enclosure when the upper chassis element is mechanically coupled with the lower chassis element.

10 Claims, 14 Drawing Sheets

(51) Int. Cl.

| | |
|---|---|
| ***H01F 27/29*** | (2006.01) |
| ***H01F 27/04*** | (2006.01) |
| ***H01F 27/06*** | (2006.01) |
| ***H01F 17/06*** | (2006.01) |
| ***H01F 27/30*** | (2006.01) |
| ***H01R 13/719*** | (2011.01) |
| *H01R 13/66* | (2006.01) |
| *H01F 17/00* | (2006.01) |
| *H01R 13/6461* | (2011.01) |

(52) U.S. Cl.
CPC ..... *H01F 27/29* (2013.01); *H01F 27/292* (2013.01); *H01F 27/306* (2013.01); *H01R 13/719* (2013.01); *H01F 2017/0093* (2013.01); *H01F 2027/065* (2013.01); *H01F 2027/297* (2013.01); *H01R 13/6461* (2013.01); *H01R 13/6633* (2013.01)

(56) References Cited

U.S. PATENT DOCUMENTS 8,072,308 B2 * 12/2011 Aboumrad ..... H01F 3/14 336/178
8,203,853 B2 * 6/2012 Chen ..... H01F 17/062 336/65
8,854,167 B2 * 10/2014 Lin ..... H05K 5/0095 336/200
2002/0057163 A1 * 5/2002 McGrane ..... H01F 27/02 336/90
2006/0291145 A1 12/2006 Takeda et al.
2007/0117458 A1 * 5/2007 Winker ..... G02B 6/4201 439/607.01
2010/0134228 A1 6/2010 Chow et al.
2011/0053418 A1 3/2011 Margulis et al.
2012/0112867 A1 5/2012 Chow et al.
2012/0309233 A1 * 12/2012 O'Malley ..... H01R 13/6469 439/626
2015/0003032 A1 1/2015 Edwards et al.

OTHER PUBLICATIONS

Invitation to Pay Additional Fees and, Where Applicable, Protest Fee for International Application No. PCT/US2014/071308, mailed Mar. 6, 2015.

* cited by examiner

COMMON MODE CHOKE AND INTEGRATED CONNECTOR MODULE AUTOMATION OPTIMIZATION

BACKGROUND

Field of the Invention

The subject technology relates to improved common mode choke (CMC) and integrated connector module (ICM) designs, and in particular, provides design improvements to optimize CMC and ICM process automation.

Introduction

Suppression of electromagnetic interference (EMI) has become a major concern in the transmission, reception, and processing of electronic signals and data. Modern communication systems are often designed as an interconnection of functional blocks and connections made using cables or wiring harnesses. Such interconnections often present opportunity for common mode current loops between devices that can lead to EMI regulatory failure.

Due to EMI concerns, Ethernet devices, such as Ethernet ICM transformers (ICMts), are often coupled with a common mode choke (CMC). A CMC can comprise two coils wound on a single core and may be useful for EMI and Radio Frequency interference (RFI) prevention from, for example, power supply lines and other sources. A CMC can pass differential currents (e.g. equal but opposite), while blocking common-mode currents. Thus, when properly operated, CMCs filter common mode currents without causing signal degradation. Therefore, the addition of CMCs, e.g., in conjunction with a connector such as an ICM, can provide filtration of mode currents, while also allowing passage of desired signals.

In some traditional configurations, CMCs and ICMs are bundled together, for example into a common ICM housing. By way of example, CMC and ICM components can be bundled into "pigtail" components, which provide connections between the CMC and ICM as well as a shared housing. Bundling of the ICM and CMC into the pigtail is a labor intensive process and makes it nearly impossible to later separate the ICM/CMC from the pigtail to make component modifications or adjustments.

For example, the ICM can include an Ethernet transformer that is configured (tuned) to block ground currents, e.g., of a corresponding Ethernet transceiver or "PHYreceiver." In contrast, the CMC is generally tuned to filter noise produced by other device components in which the ICM is disposed. Because noise resulting from the other components can vary with the life of the device, or as device changes are made, it is not uncommon to require re-tuning of the CMC. To simplify the ability to tune/re-tune the choke, some Ethernet implementations provide physically decoupled CMC and ICM modules (as opposed to pigtails in which the respective components cannot be easily decoupled).

In such configurations, separate CMC and ICM components are physically separated but electrically coupled, for example, via a printed circuit board (PCB). The physical decoupling of CMC and ICM components can provide the groundwork for several advantageous modifications to conventional CMC and ICM architecture.

SUMMARY

Aspects of the subject technology provide a common mode choke (CMC) component including a housing, the housing including an upper chassis element and a lower chassis element, the upper chassis element comprising a first plurality of comb structures vertically disposed around an edge of the upper chassis element. In certain aspects, the lower chassis element includes a second plurality of comb structures vertically disposed around an edge of the lower chassis element, the second plurality of comb structures configured to interlock with the first plurality of comb structures to form an enclosure when the upper chassis element is mechanically coupled with the lower chassis element. Additionally, in some implementations, a mechanical coupling between the upper chassis element and the lower chasses element forms a wire gap between an inside of the enclosure and an outside of the enclosure.

In yet another aspect, the subject technology relates to an integrated connector module transformer (ICMt), including a wafer configured to hold a plurality of toroid elements, and wherein the wafer is comprised of a two or more mechanically coupled wafer portions. In certain implementations, the ICMt can further include a plurality of tie-off pins configured to protrude from at least one of the two or more wafer portions, and wherein the tie-off pins are disposed at an angle between two and eighty-eight degrees with respect to the at least one of the two or more wafer portions.

It is understood that other configurations of the subject technology will become readily apparent to those skilled in the art from the following detailed description, wherein various configurations of the subject technology are shown and described by way of illustration. The subject technology is capable of other and different configurations and its several details are capable of modification in various respects without departing from the scope of the subject technology. Accordingly, the detailed description and drawings are to be regarded as illustrative and not restrictive in nature.

BRIEF DESCRIPTION OF THE DRAWINGS

Certain features of the subject technology are set forth in the appended claims. However, the accompanying drawings, which are included to provide further understanding, illustrate disclosed aspects and together with the description serve to explain the principles of the subject technology. In the drawings:

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a more thorough understanding of the subject technology. However, it will be clear and apparent that the subject technology is not limited to the specific details set forth herein and may be practiced without these details. In some instances, structures and components are shown in block diagram form in order to avoid obscuring the concepts of the subject technology.

Figure 1:
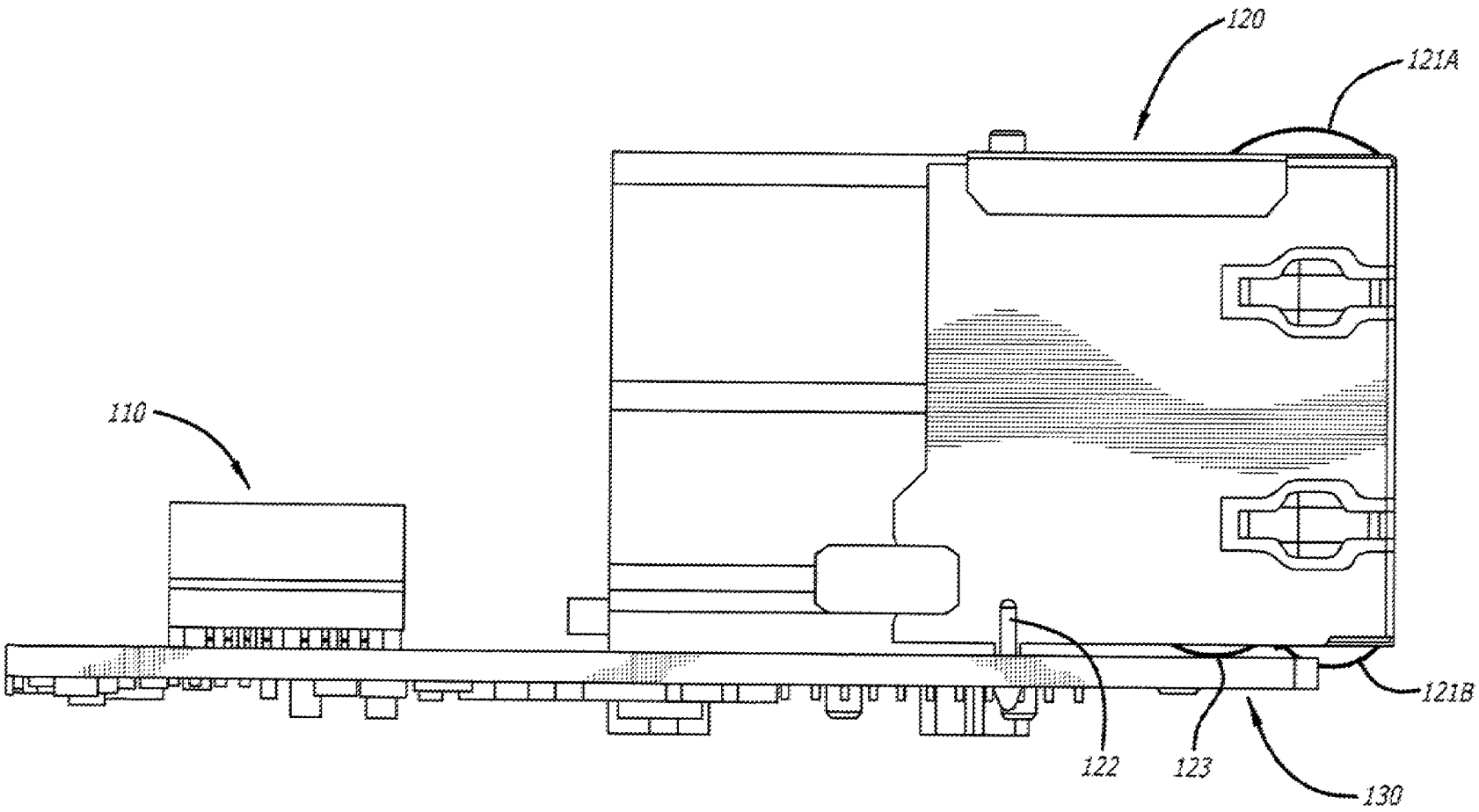
FIG. 1 illustrates an example of a common mode choke (CMC) and integrated connector module transformer (ICMt), according to certain aspects of the subject technology.

FIG. 1A illustrates an example of a CMC/ICM configuration in which CMC 110 and ICM 120 are provided as separate component parts. Specifically, FIG. 1 depicts CMC 110 and ICM 120 as physically separated, but electrically coupled via printed circuit board (PCB) 130.

As shown in FIG. 1A, ICM 120 also includes EMI fingers 121A and 121B that are positioned to provide contact between ICM 120 and a surrounding enclosure or EMI shield (not shown). By providing an electrical contact to a surrounding enclosure, EMI fingers 121A and 121B provide a ground signal path from ICM 120 into an external ground, decreasing the likelihood that EMI will affect ICM or system performance. To this end, ICM 120 also includes ground pin 122 and EMI finger 123, which both provide an electrical connection to the circuit ground of PCB 130. The relatively forward position of EMI finger 123 can help to dissipate stray electrical signals before they reach other components (or ground pin 122). The addition of EMI fingers (such as EMI finger 123) to ICM 120 helps reduce the need for electrical shielding (e.g., faraday shielding) that is conventionally used to enclose side, top and back portions of ICM 120.

As discussed in further detail below, the physical separation of CMC 110 and ICM 120 is instrumental in realizing design advantages for each respective component.

Common Mode Choke Geometry:

One problem in conventional CMC designs relates to the way in which toroid wire management is performed throughout assembly. In conventional deigns, toroid wires are jumbled together and left to protrude from a single opening of the CMC enclosure, and must then be manually sorted and separated before being tied off. This wire management process is both cumbersome and time consuming, adding to the difficulty and cost of CMC manufacture. As such, there is a need for an improved CMC housing geometry, which facilitates toroid wire management.

Another problem in conventional CMC designs relates to the way in which toroid wires (of a magnetic toroid element) are tied off, for example, onto pegs external to the CMC housing. In conventional CMC designs, the pegs are of a circular or square shape and distend from the outer housing surface. These pegs are configured to receive the ends of the toroid wires, which are wrapped around the pegs and broken off during the assembly process. However, the force produced from stretching (and breaking) the wire often causes the supporting (symmetrical) peg to shear off from the housing. Accordingly, an improved peg geometry is needed to enhance overall durability of the CMC housing and to provide pegs that are strong enough to resist greater shear forces.

Aspects of the technology address both of the foregoing problems by providing a CMC enclosure that facilitates toroid wire management, as well as an improved peg geometry that provides strengthened bonds between the pegs and supporting CMC chassis.

Figure 2A:
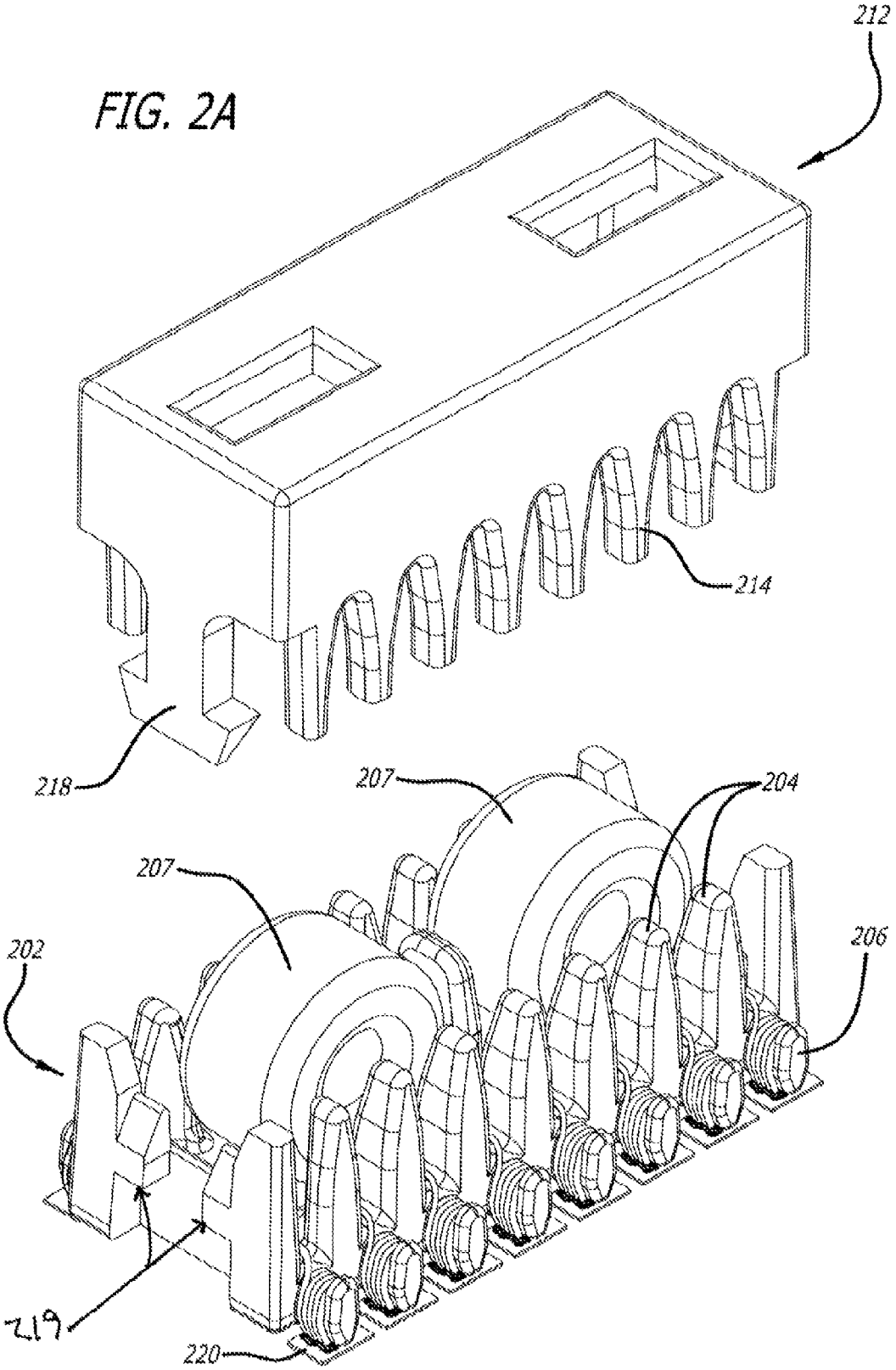
FIG. 2A illustrates an exploded view of an example of a CMC housing, according to certain aspects.

FIG. 2A illustrates an example of an exploded view of a CMC housing, including an upper chassis element 212 and a lower chassis element 202. Upper chassis element 212 includes comb structures 214 as well as a clip 218. In certain aspects, the geometry of comb structures 214 is configured to integrate with an opposing geometry of lower chassis element 202. Similarly, the geometry of clip 218 is configured to mechanically couple upper chassis element 212 with lower chassis element 202.

Lower chassis element 202 includes comb structures 204 that are configured to alternating integrate with comb structures 214 of upper chassis element 212. Lower chassis element also includes a clip insert 219 which is configured to mate with clip 218 to the hold upper chassis element 212 and lower chassis element 202 together. More specifically, the interlocking of comb structures 204 with comb structures 214 operates to provide a wire-gap, as discussed in further detail below. As further illustrated, lower chassis element also includes pegs 206, each of which correspond with respective solder pads 220. In the illustration of FIG. 2A, magnetic toroids (or toroid elements) 207 are shown as disposed within lower chassis element 202; however, it is understood that a greater number (or lesser number) of toroid elements can be disposed within the CMC, depending on the desired implementation.

In operation, wires from toroid elements 207 pass from the toroid (on the interior of the CMC enclosure), through an adjacent wire-gap provided by the coupling of comb structures (204,214), and out of the CMC enclosure. Wires protruding out from the CMC housing through the wire-gap are then tied off on an adjacent peg (e.g., one of pegs 206). As discussed below, assembly of the CMC involves ablating the wire wrapped on pegs 206 using an incident laser, to remove any lacquer or insulation. Subsequently, a solder joint is formed between the wrapped wire and a corresponding solder pad (e.g., solder pad 220).

Figure 2B:
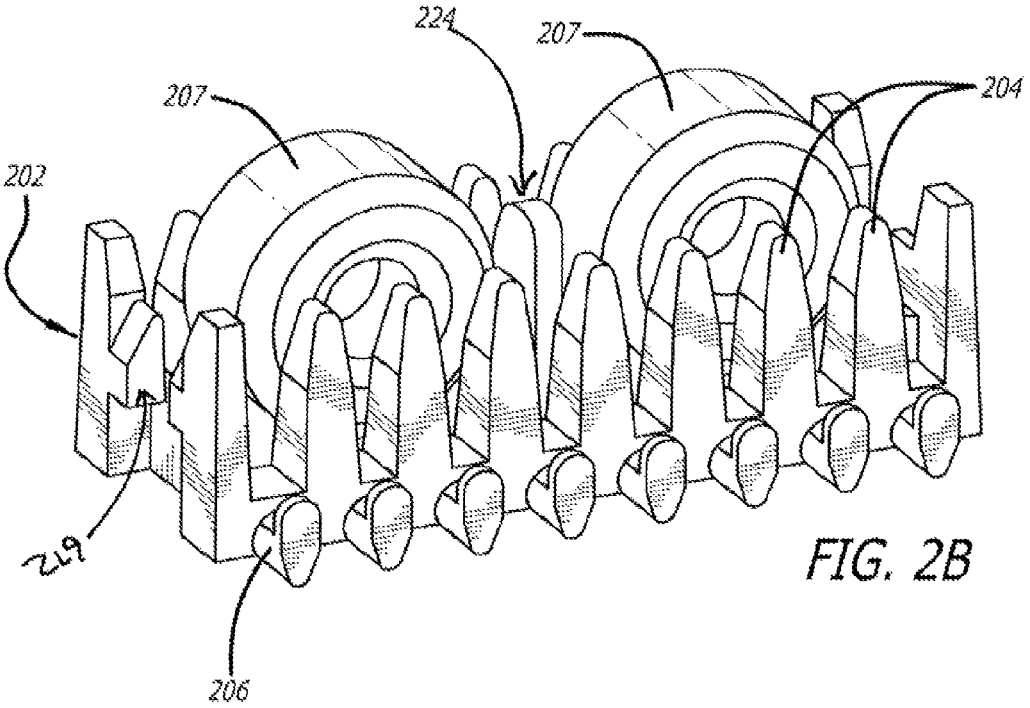
FIG. 2B illustrates an example of a lower chassis element of a CMC housing, including multiple toroid elements, according to certain aspects of the technology.

FIG. 2B illustrates an example of a lower chassis element 202, together with toroids 207, which are separated by separator 224. In the view of FIG. 2B, an exemplary peg geometry is depicted by pegs 206, which are shown without a wire wrap. Although pegs 206 can be differently shaped depending on implementation, in certain aspects, the geometry of pegs 206 is asymmetrical, yet substantially round in shape. Asymmetrical peg geometries (such as that shown in FIG. 2B), can help improve peg resistance to shear forces experienced by the pegs in during toroid wire tie-off. In addition to providing a stronger peg foundation, asymmetrical peg geometries also provide an improved surface on which toroid wire can be wound and ablated to remove insulation.

By way of example, a preferred peg geometry can include a shape that is larger in the middle (or center) to improve peg strength. Additionally, in some implementations, a top surface of the peg is larger (e.g., of a greater surface area) compared to that of the bottom surface. An increased surface area on the top side of the peg can increase exposure of the corresponding wire wrap to laser light incident on the top surface (e.g., for removal of lacquer or insulation) during the CMC manufacture process. In contrast, a more narrow shape (e.g., smaller surface area) on the bottom side of the peg helps to provide an angular shape that is more conducive to the formation of strong solder joints, e.g., as between the wrapped toroid wire and the corresponding solder pad, e.g., solder pad 220 illustrated in FIG. 2A.

Lower chassis element further includes separator 224 which provides a non-conductive barrier between toroids 207. The configuration of separator 224 and comb structures 204 mechanically restrains toroids 207, without the use of epoxy or silicone bonding agents, which affect the electrical and/or magnetic properties of toroids 207. By eliminating the need for conductive toroid restraints, the dielectric of toroids 207 remains equal to that of the air filling the gaps in the CMC housing. As such, the mechanical restraint features of CMC 110 serve to enhance the electrical properties of conditions in and around the CMC housing.

Figure 2C:
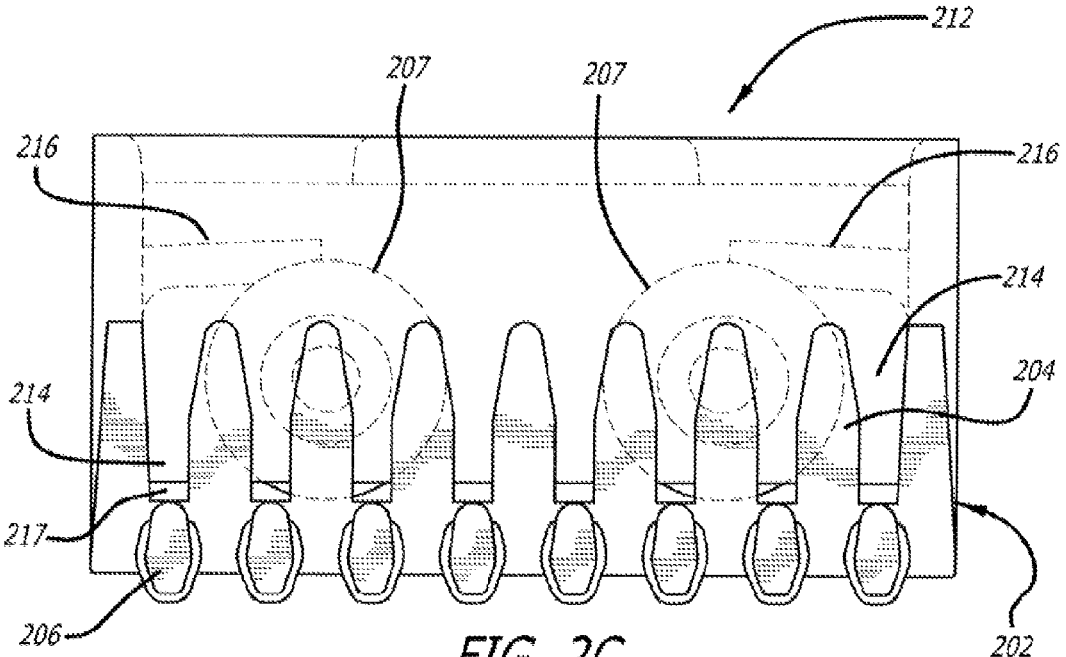
FIG. 2C conceptually illustrates an example of the coupling between an upper chassis element and lower chassis element for form a CMC housing, according to certain aspects of the technology.

Additional features of the CMC housing, including additional restraint mechanisms, are provided when upper chassis element 212 is coupled with lower chassis element 202. FIG. 2C illustrates an example of the coupling between an upper chassis element and lower chassis element for forming a CMC housing.

Specifically, in FIG. 2C, upper chassis element 212 is shown to be fixed to lower chassis element 202, causing combs 214 and 204 to alternating integrate to form wire gap 217, which can be used to separate/manage toroid wires that are to be wrapped around pegs 206. That is, the interlocking of combs 214 and 204 causes the toroid wires to become trapped, and prevents the straying or shifting of wires during assembly.

In certain aspects, cooperation between upper chassis element 212 and lower chassis element 202, (e.g., to form the CMC housing) is accomplished using a mechanical locking mechanism. By way of example, clip 218 of upper chassis element 212 is configured to connect with lower chassis element 202 using clip insert 219.

In certain aspects, upper chassis element 212 also includes restraint features for imparting a force on toroids 207, to provide further mechanical support. For example, upper chassis element 212 includes spring fingers 216 that are disposed on the inner surface of upper chassis element 212. When upper chassis element 212 is lowered on onto lower chassis element 202, spring fingers 216 contact with, and mechanically secure toroids 207.

Figure 2D:
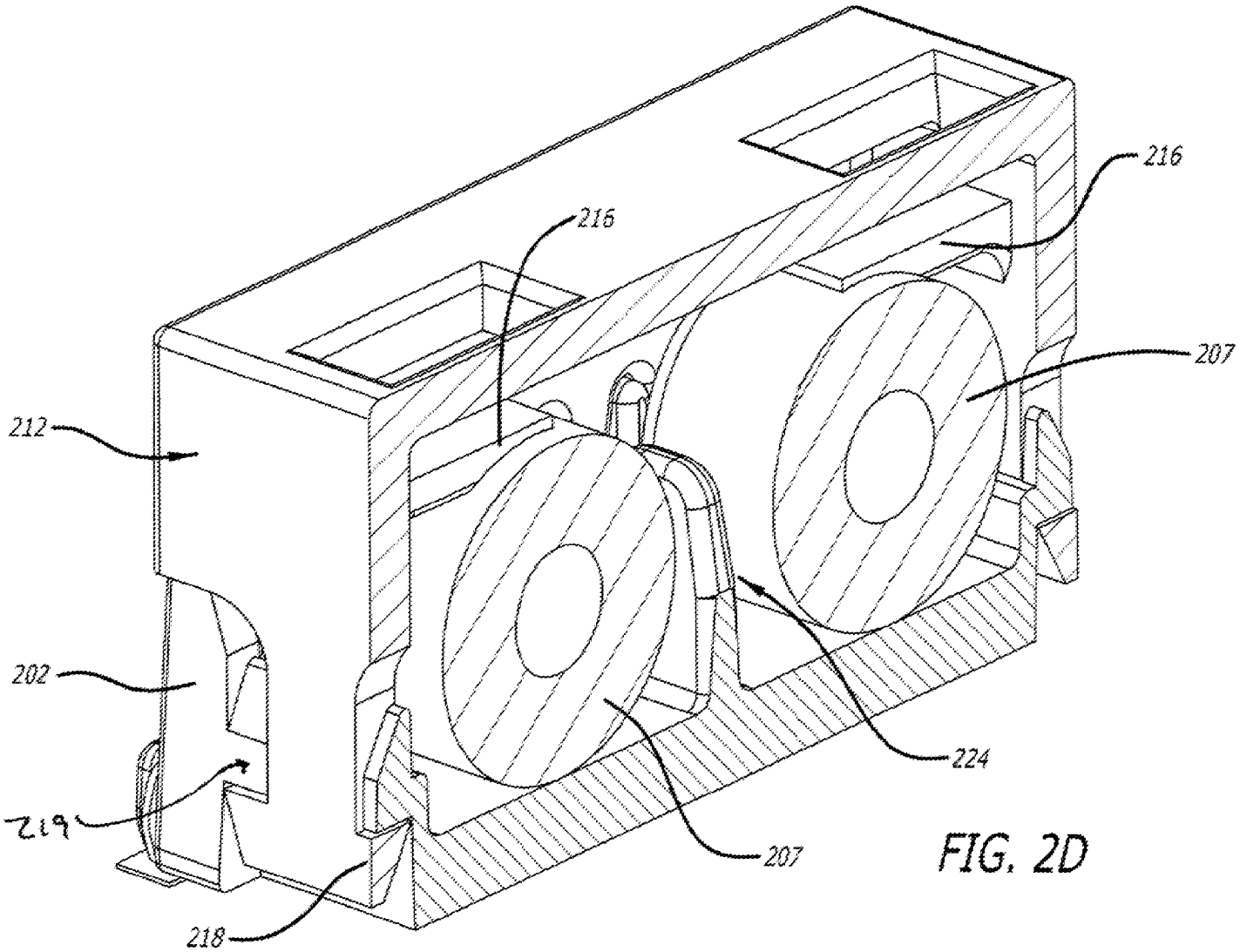
FIG. 2D conceptually illustrates a cut-away view of an assembled CMC housing, including magnetic elements, according to some aspects of the technology.

A further illustration of the contact between spring fingers 216 and toroids 207 is provided by FIG. 2D, which conceptually illustrates a cut-away view of an assembled CMC housing, including magnetic elements, according to some aspects of the technology. FIG. 2D further illustrates how clip 218 can be used for coupling upper chassis element 212 with lower chassis element 202, as well as the separation of toroids 207 using separator 224. As discussed above, the mechanical restraint provided by spring fingers 216 and separator 224 eliminates the need to use filling or bonding agents, such as epoxy or silicon, which can alter the electrical properties of toroids 207 and/or introduce moisture into the CMC housing.

Figure 2E:
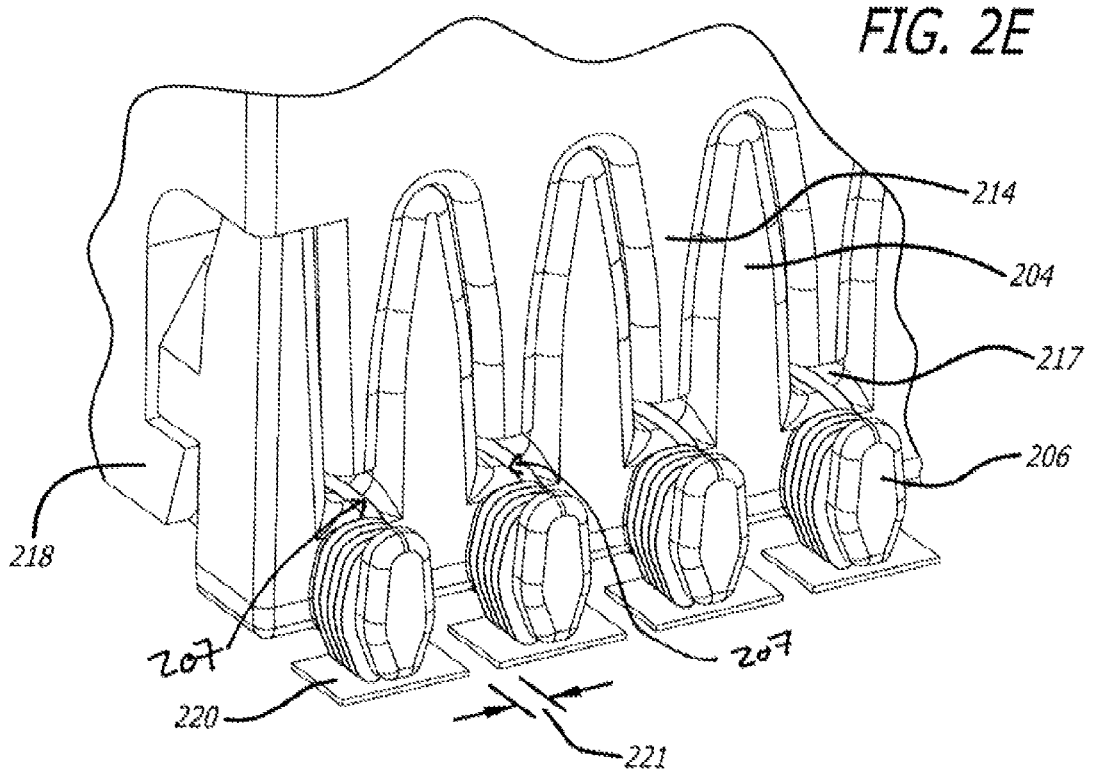
FIG. 2E illustrates a side perspective view of a CMC housing, including a plurality of pegs, each including a respective toroid-wire tie off, according to some aspects of the technology.

FIG. 2E, provides a perspective view of a manner in which combs 214 (e.g., of upper chassis element 212) can mechanically integrate with combs 204 of lower chassis element 202. As illustrated, the cooperation of combs 214 and combs 212 form wire gaps 217, which allow space for toroid wires 207. As shown, toroid wires 207 are pulled from the interior of the CMC housing (and through wire gaps 217) are wrapped around corresponding pegs 206. Thus, wire gaps 217 provide a space through which toroid wires 207 may be separated/sorted before being wound and terminated on pegs 206.

As further shown in FIG. 2E, each of pegs 206 is paired with a respective solder pad 220, that provides a surface against which a solder joint (e.g., a SMT solder joint) may be formed. A distance 221 separating solder pads is also shown, which can be determined based on a minimum clearance needed to sufficiently reduce cross talk interference between adjacent pads.

Figure 2F:
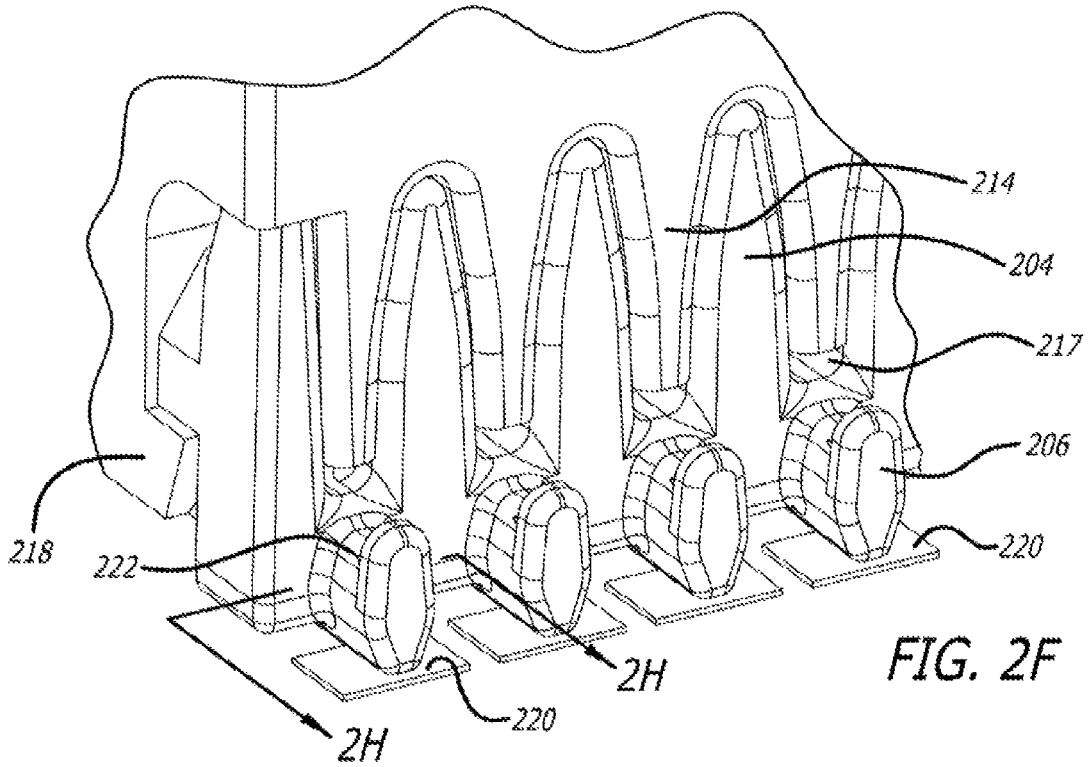
FIG. 2F illustrates a side illustrates a side perspective view of a CMC housing, including a plurality of pegs (without toroid wires), according to some aspects of the technology.

FIG. 2F illustrates a view similar to that of FIG. 2E, but with the toroid wires 207 removed to further reveal the geometry of pegs 206. In certain aspects, an outermost portion of the pegs is larger in circumference than the supporting shaft portion fixed to the outer surface of lower chassis element 202. In certain implementations, this geometry helps to prevent the toroid wire from slipping from the supporting peg. A more detailed perspective of a peg is illustrated in FIG. 2G.

Figure 2G:
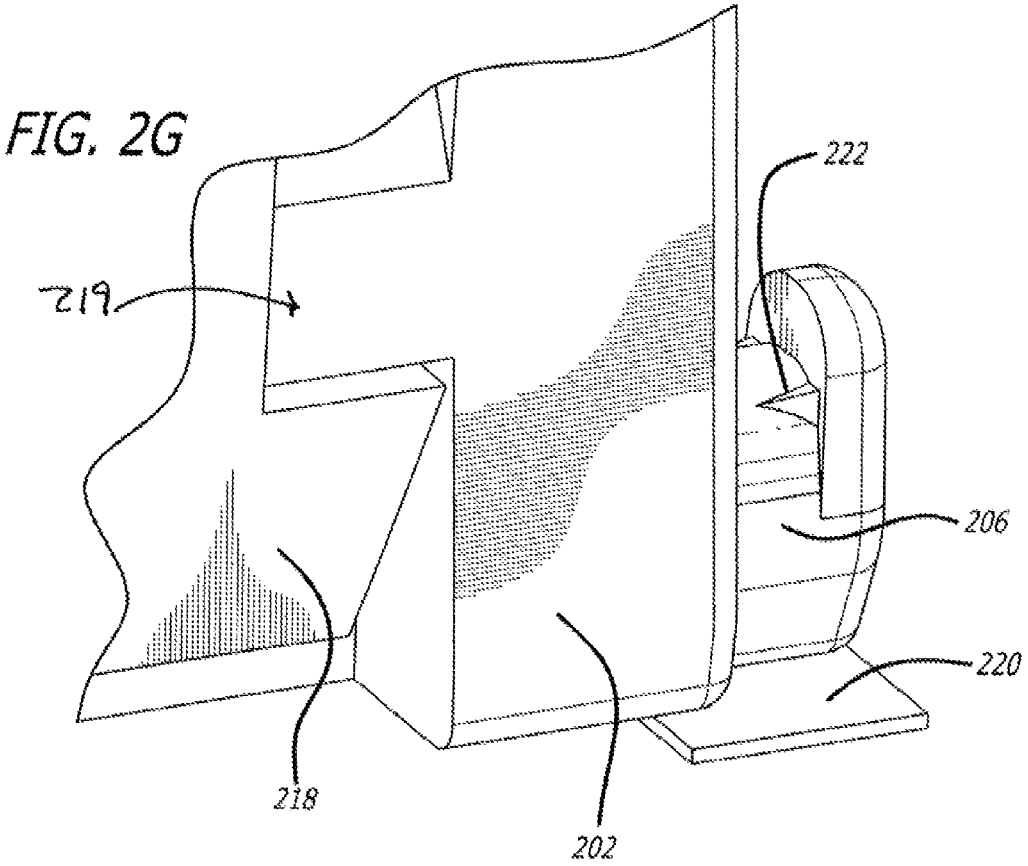
FIG. 2G illustrates a perspective view of a peg, including a wire cutting mechanism, according to some aspects of the technology.

Specifically, FIG. 2G illustrates a side perspective view of a peg (e.g., peg 206), including a wire cutting mechanism 222, according to some aspects of the technology. As illustrated, wire cutting mechanism 222 is placed on a top corner edge of the shaft supporting peg 206. However, it is understood that wire cutting mechanism 222 may be disposed in other (or multiple) locations around peg 206, depending on implementation. By way of example, a cutting mechanism may be provided on an inner surface of the larger portion of peg 206, as discussed above.

In operation, wire cutting mechanism 222 facilitates the severance of wires as they are pulled from peg 206 during the CMC assembly process. For example, after the completion of toroid wire wrapping, the wire is pulled against cutting mechanism 222, causing the wire to sever and break off. By providing cutting mechanism 222, smaller forces can be exerted to break/cut the wrapped toroid wire, reducing the likelihood that the peg will shear or twist off from the supporting chassis element.

In some implementations, after toroid wrapping is complete, the wrapped toroid wire is subjected to laser stripping e.g., by laser light incident on the top of the peg surface. Laser stripping removes insulation from the wrapped toroid wire. In certain aspects, peg geometries, such as that of pegs 206, facilitates the laser stripping process, for example, by providing a flatter and larger surface area on the top side of the peg which can be reached with laser light. Additionally, the substantially flat top outer surface of the peg can help to reduce reflection of incident light, increasing the efficacy of laser ablation on the top surface. Thus, the geometry of pegs 206 not only improves mechanical integrity, but also facilitates the preparation and soldering of toroid wire. Further advantages of the subject peg geometry are illustrated by the view provided in FIG. 2H.

Figure 2H:
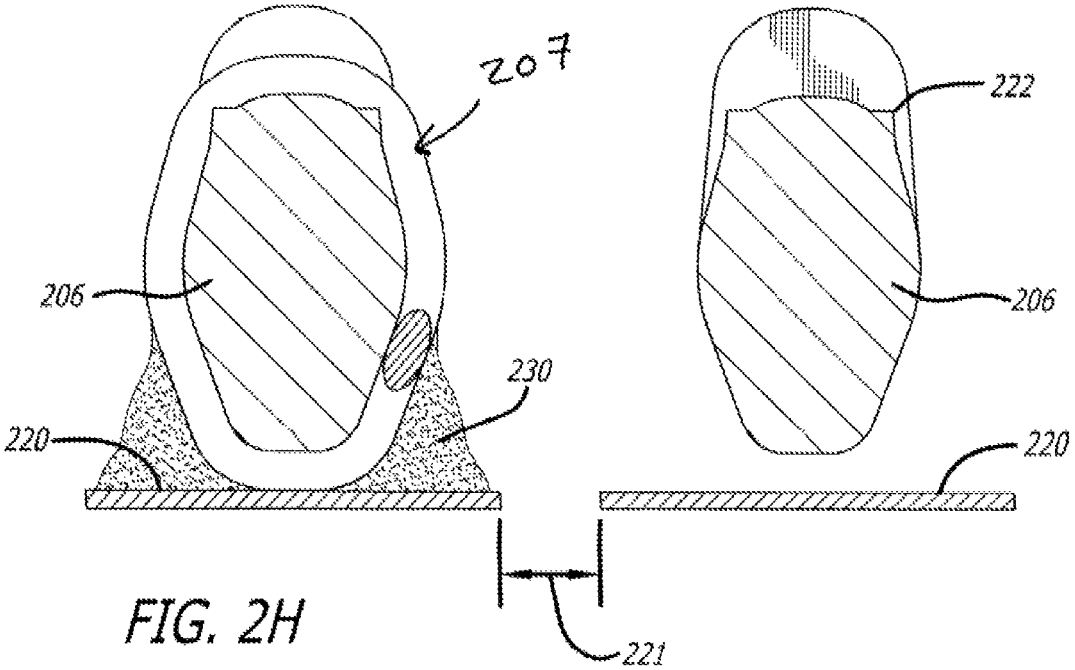
FIG. 2H provides a cut away view of pegs illustrated by FIG. 2F, according to some aspects of the technology.

Specifically, FIG. 2H provides a cut-away view of the pegs 206 illustrated in FIG. 2F, discussed above. In the example of FIG. 2H, wire cutting mechanisms 222 are shown on both sides of the top peg surface. However, as discussed above, wire cutting mechanisms can be disposed at additional or different locations around the peg surface.

FIG. 2H also illustrates an example of a solder joint 230 that is provided between solder pad 220 and the toroid wire of peg 206. In certain implementations, the geometry of peg 206 provides angular edges along the lower surface, which facilitates the formation of a triangular shaped solder joint, such as solder joint 230. Such angles provide an increased surface area of contact as between the wrapped toroid wire and solder joint 230, as well as solder joint 230 and solder pad 220.

Figure 3A:
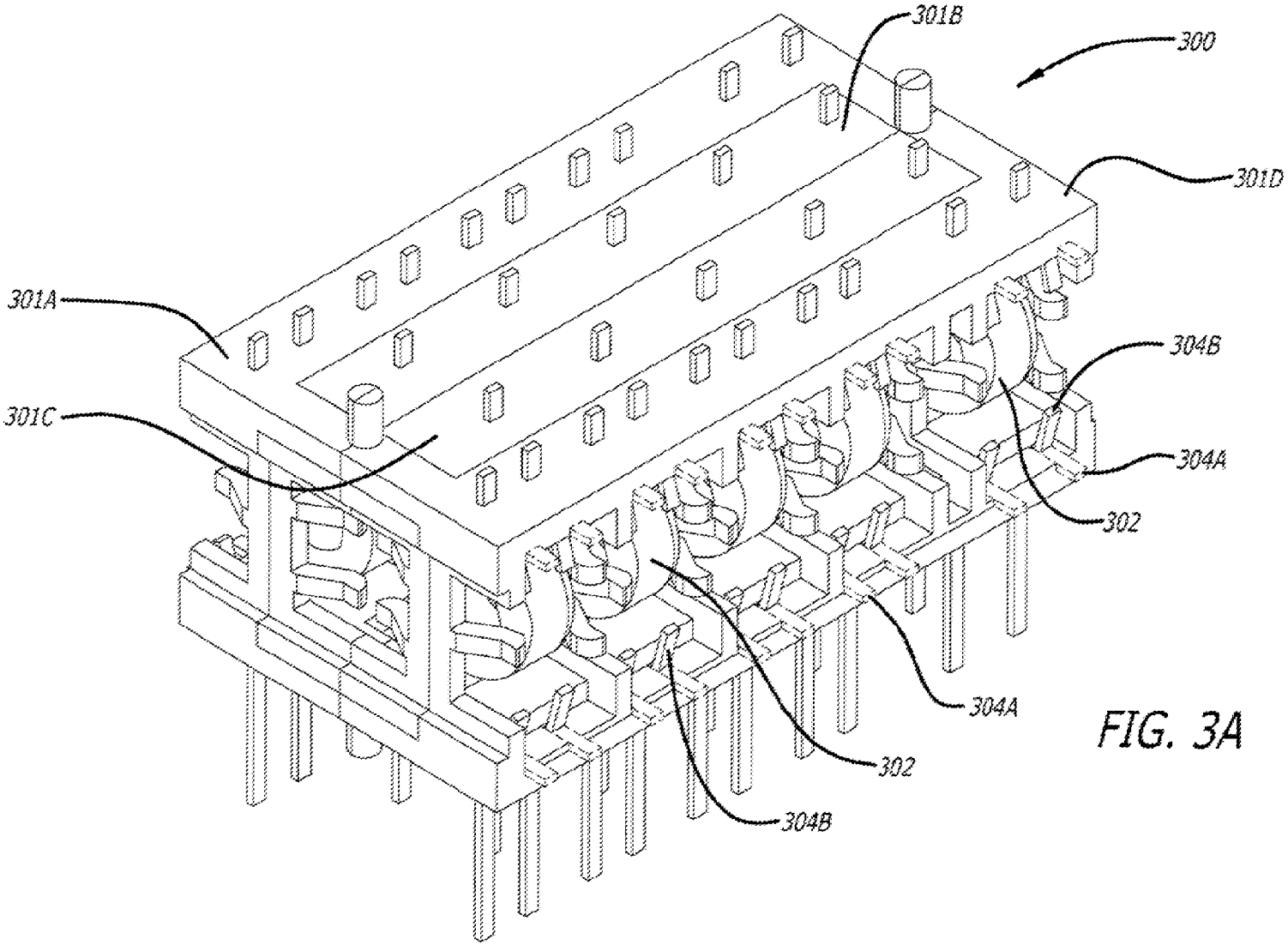
FIG. 3A illustrates an example of a perspective view of an integrated connector module (ICM) component, according to some aspects of the subject technology.

FIG. 3A illustrates an example of a perspective view of an integrated connector module (ICM) component 300. In certain aspects, a chassis of the ICM can be comprised of two more wafer portions. For example, in the illustration of FIG. 3A, ICM 300 includes first wafer 301A, second wafer 301B, third wafer 301C, and fourth wafer 301D. Additionally, ICM 300 includes toroids 302, as well as toroid wire tie-off pins ("pins"), shown in a first position (304A), as well as a second position (301B). It is understood that an ICM of the subject technology can include a greater (or fewer) number of wafer portions from that illustrated in FIG. 3A. Similarly, a greater or lesser number of toroids and/or pins can be used, without departing from the scope of the invention.

Figure 3B:
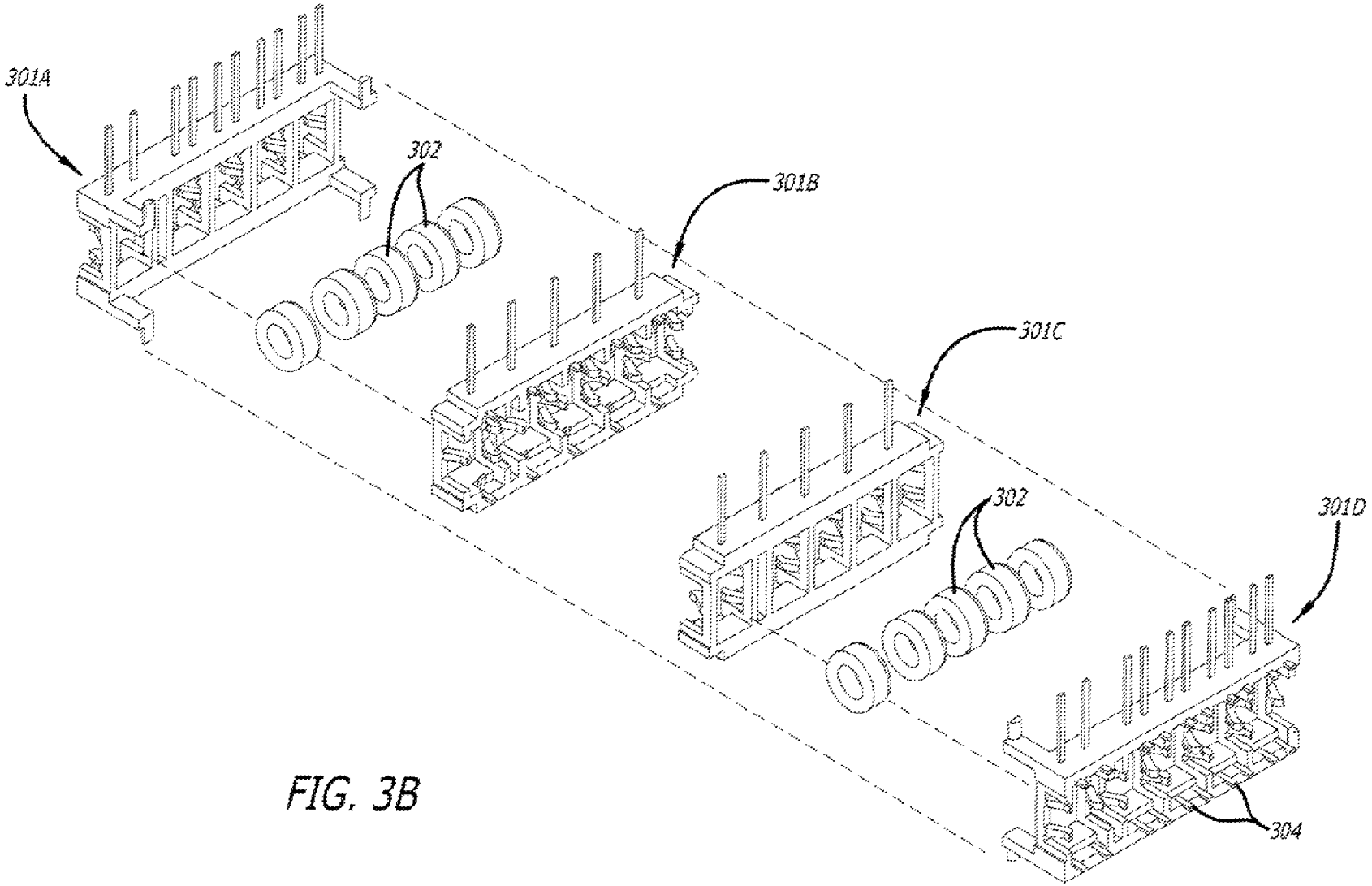
FIG. 3B conceptually illustrates an exploded view of an example ICM chassis having multiple wafer portions, according to some aspects of the technology.

A more detailed view of the ICM wafer assembly is shown in FIG. 3B, which illustrates an exploded perspective view of ICM 300. In some implementations, the various wafer portions of ICM 300 (e.g. first wafer 301A, second wafer 301B, third wafer 301C and fourth wafer 301D), can be held together using physical clips or hooks (as illustrated) to provide a mechanical coupling between the different wafer portions, forming the chassis of ICM 300. However, it is understood that other mechanical means can be used to form a coupling between multiple wafer portions of the ICM chassis.

By using a mechanical mechanism to couple the multiple wafer portions, an ICM of the subject technology eliminates the need for adhesives such as epoxy or silicon, which can alter the electrical properties of toroids 302 and slow the ICM production process. As such, waferization of the ICM chassis provides several advantages, including improving the dielectric properties of toroids 302 (e.g., by eliminating conductive bonding media) and streamlining the ICM production process.

Aspects of the subject technology also provide an improved process and ICM geometry for relieving mechanical strain placed on toroid wires that are tied off on pins 304. Specifically, in some implementations, as illustrated in FIG. 3A, toroid wires are tied off onto pins 304A (in a first position), wherein pins 304A are substantially perpendicular to the ICM chassis body. After the toroid wires have been tied off, the pins are bent into a second position (304B), creating slack in the toroid wire connection between the toroid and the corresponding pin.

Figure 3C:
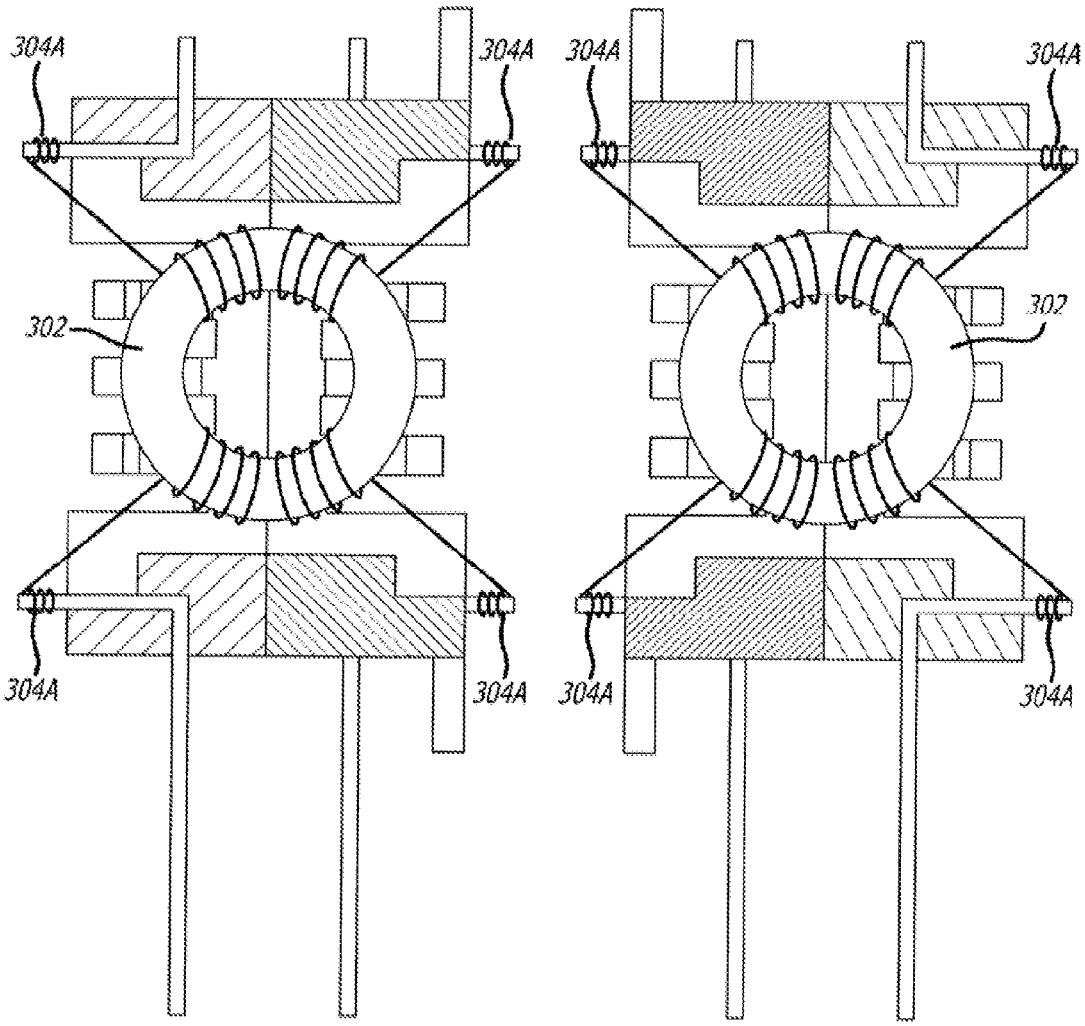
FIGS. 3C, 3D, and, 3E illustrate a cut-away view of an ICM, including toroid tie-off pins, according to some aspects of the technology.
Figure 3D:
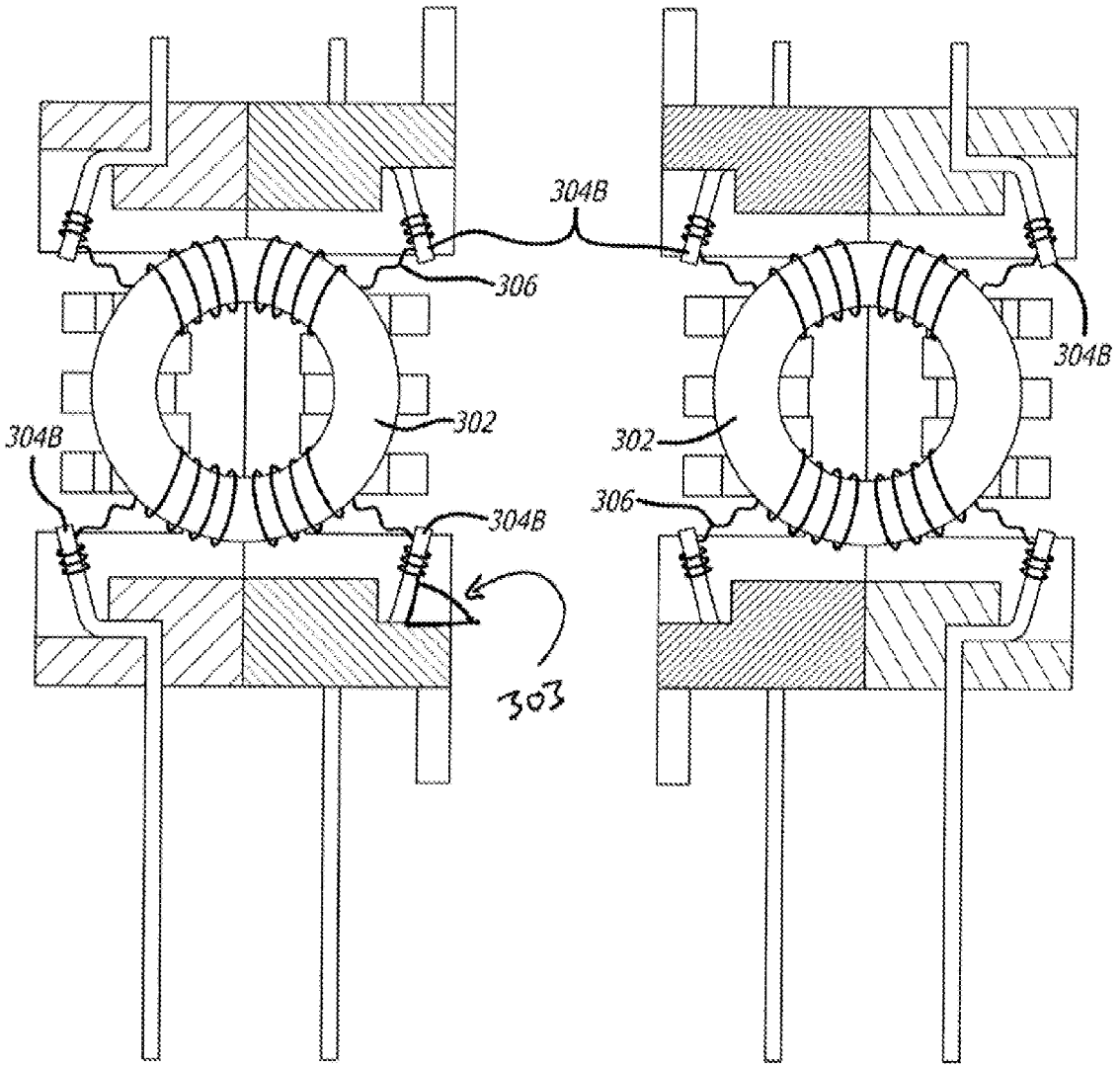

FIGS. 3C-3D illustrate ICM configurations throughout a process for creating slack in tied-off toroid wires, according to some implementations. Specifically, FIG. 3C illustrates two separate wafer assemblies, each including toroids 302. Wires wrapped around toroids 302 are tied off onto pins 304A, creating tension on the respective wires. To relieve the tension, the pins are shifted into an angled position (e.g., 304B), as shown in FIG. 3D. In the illustrated example, angle 303 indicates an amount of angular movement experience from pin position 304A to 304B.

Once pins 304B are in their final (angled) positions, the separate wafer assemblies are combined. It is understood that the angle of pins 304B with respect to the supporting chassis (or wafer) can vary with implementation. For example, pins 304B can come to rest at an angle that is greater than zero, but less than ninety degrees, with respect to the supporting chassis body.

Figure 3E:
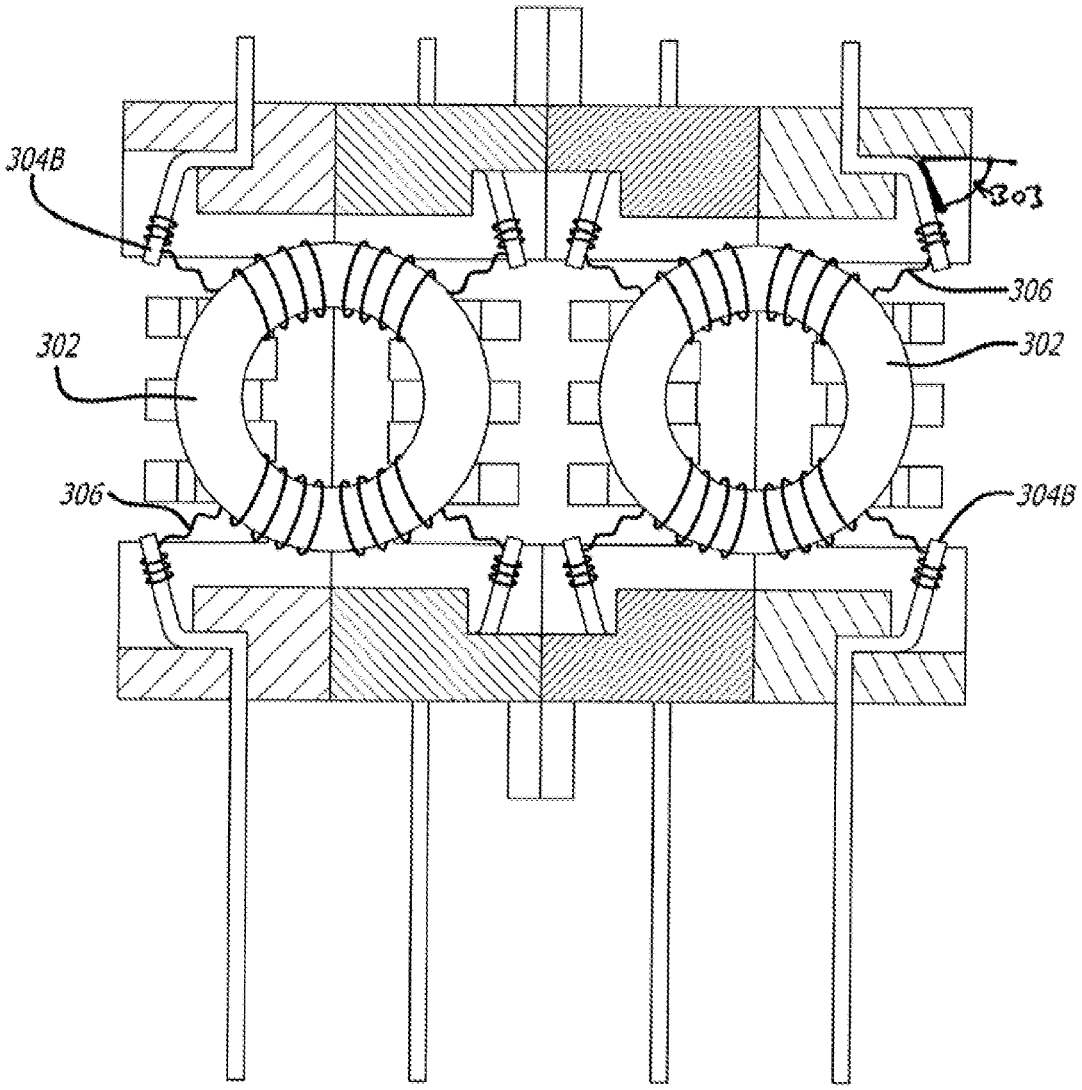

FIG. 3E illustrates final positions of pins 304B, as well as the separate wafer portions. In certain aspects, wafer bonding first requires the bending of pins 304A, so that the pins do not interfere with the mechanical coupling of separate wafer portions.

As discussed above with respect to FIG. 1, separation of CMC 110 and ICM 120 components can provide the basis of design improvements to both component parts. Likewise, physical separation of CMC 110 and ICM 120 can facilitate improvements to PCB design, such as that of PCB 130.

Figure 4A:
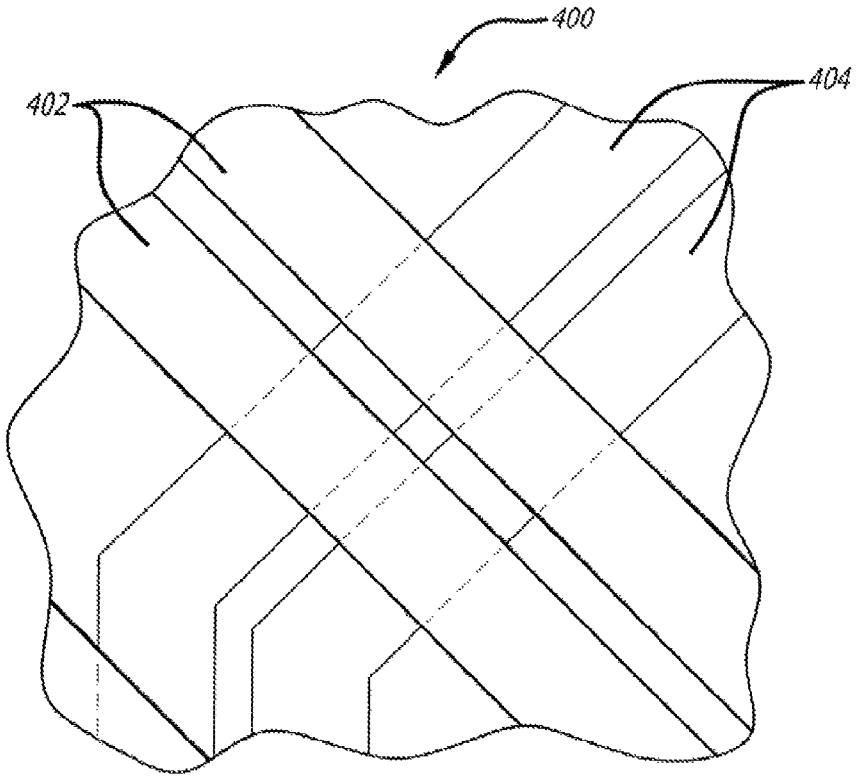
FIG. 4A illustrates an example of a dual-layer printed circuit board (PCB) according to some aspects of the technology.

Turning to FIG. 4A which conceptually illustrates an example of a PCB 400 that is implemented using two-layer routing. As illustrated, FIG. 4A depicts two sets of routing paths, e.g., first routing path 402 and second routing path 404, In certain aspects, first routing path 402 and second routing path 404 are provided on different layers of PCB 130. By way of example, first routing path 402 can be configured to cross over second routing path 404 using an orthogonal (i.e., 90 degrees) crossover e.g., to reduce cross-talk interference. By implementing two-layer routing in PCB 400, the subject technology can serve to reduce manufacturing costs, without realizing unacceptable levels of EMI or cross talk interference in PCB 400.

Figure 4B:
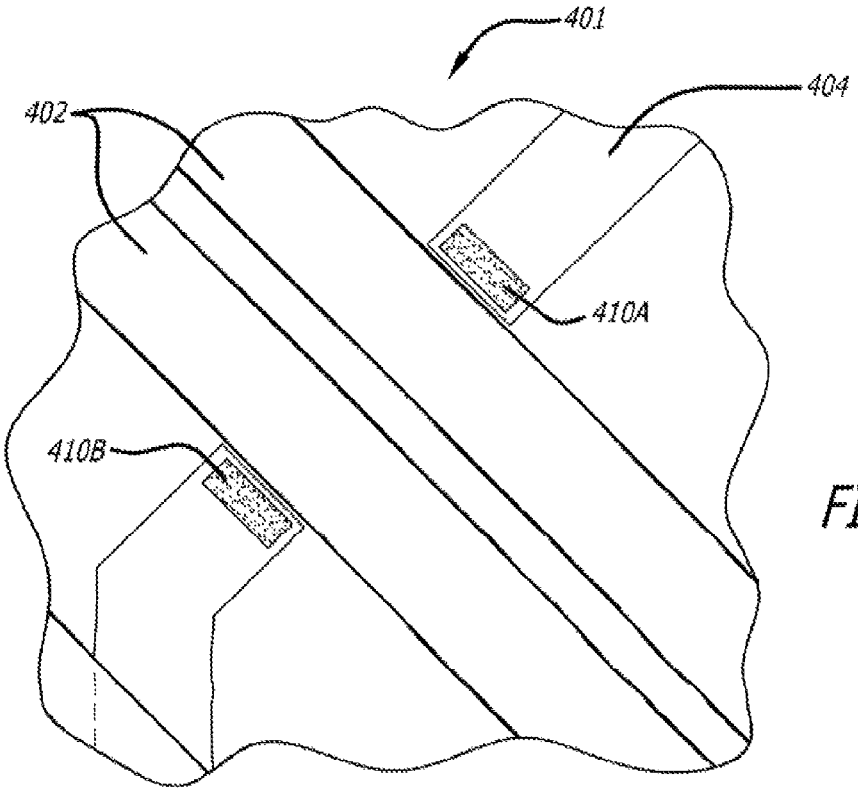
FIG. 4B illustrates an example of a single-layer PCB, according to some aspects of the technology.

In another implementation, a PCB of the subject technology can be implemented using single layer routing. For example, FIG. 4B illustrates an example of a PCB 401, that includes route 403 and route 405 that are provided on a common layer. In certain aspects, route 405 can be configured to cross route 403 using a capacitive element (not shown) that is connected across pads 410A and 410B. That is, route 405 is provided through a capacitive element (e.g., a capacitor) via pads 410A and 410B.

Figure 5:
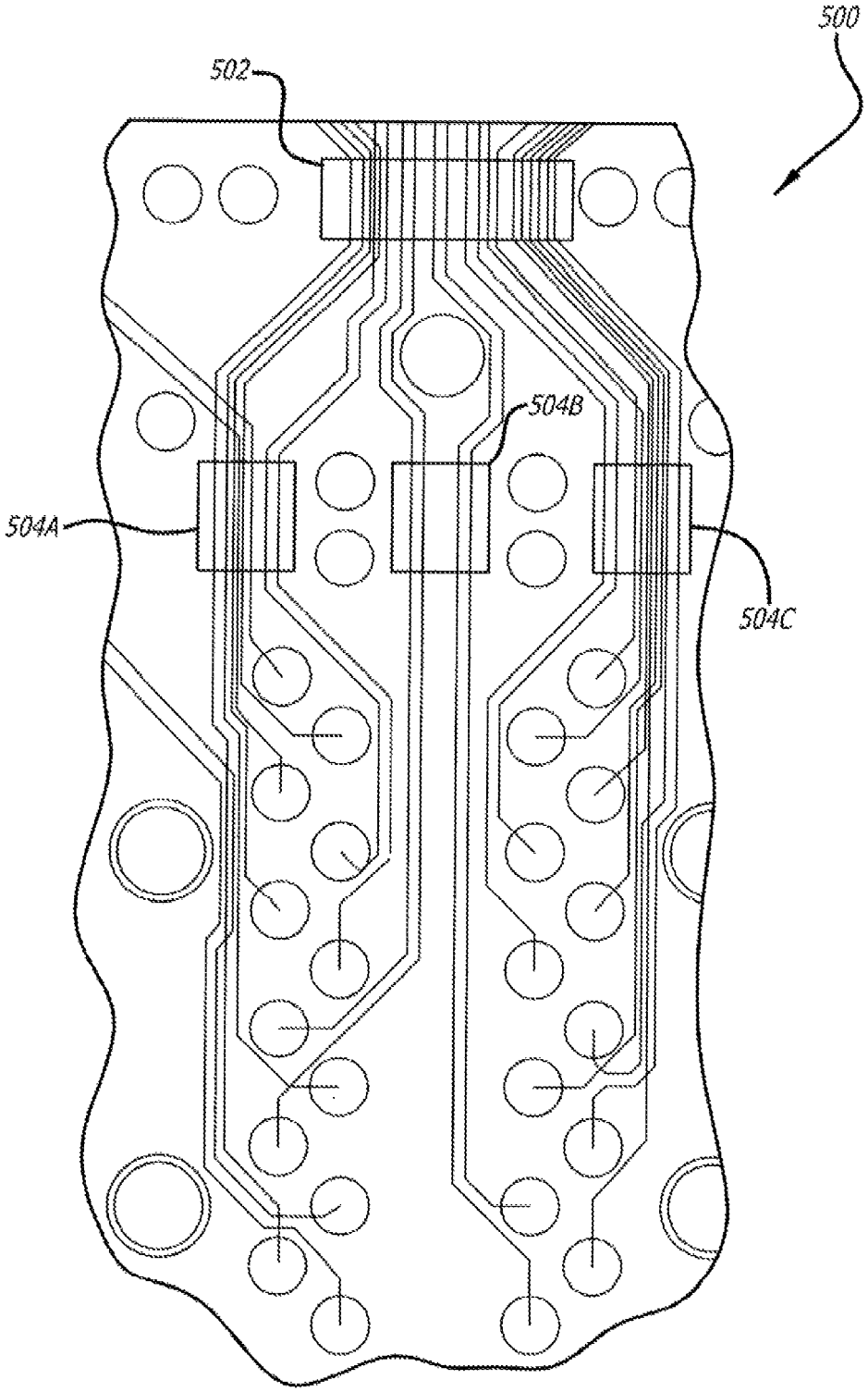
FIG. 5 illustrates an example of Ethernet channel routing on a PCB, according to some aspects of the technology.

In some implementations, a PCB board of the subject technology provides a unique channel routing e.g., for Ethernet channel routing. FIG. 5 illustrates an example of a PCB 500, which includes a first Ethernet channel 502, which is separated into three channel slices, e.g., first channel slice 504A, second channel slice 504B and third channel slice 504C.

Although the number of channels carried by the channel slices, as well as the width of each individual channel slice can vary with implementation, in certain aspects first channel slice 504A, second channel slice 504B and third channel slice 504C will carry a combined total of eight differential Ethernet pairs at an approximately 75 ohm impedance.

In another aspect, a PCB of the subject technology (e.g., PCB 130), provides straight runs from a front of the board to the back of the board. For example, with reference to FIG.

1, printing of PCB 130 can provide substantially straight routing from ICM 120 through CMC 110.

Figure 6:
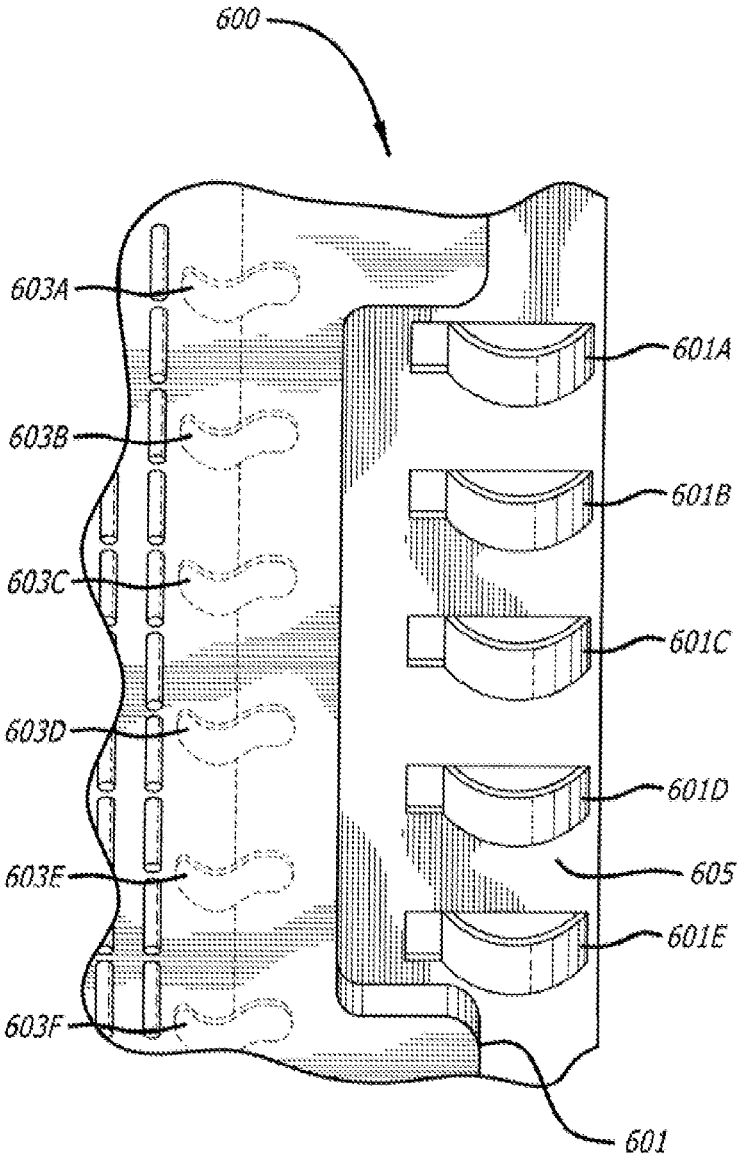
FIG. 6 illustrates an ICM grounding configuration which utilizes case contact pins and PCB contact pins, according to certain aspects of the technology.

FIG. 6 provides an example of a bottom perspective view of an ICM assembly 600, which includes a PCB 601 and an ICM wrapper 605. As illustrated, a set of first contact fingers (e.g., contact fingers 601A-E) extend from ICM wrapper 605. Additionally, a second set of contact fingers (e.g., contact fingers 603A-603F) is shown underneath PCB 601.

In operation, first contact fingers 601A-E are configured to make electrical contact between an external chassis or case (not shown), when the case is fitted over ICM assembly 600. Accordingly, first contact fingers 601A-E an electrical coupling from ICM wrapper 605 and a case ground. The electrical connection between contact fingers 601A-E and the case provides a path by which stray EMI currents can be safely dissipated, without affecting other device components.

Similarly, the second set of contact fingers (e.g., 603A-603F) provide a ground connection between an ICM (not shown), and PCB 601. In certain aspects, the additional ground path provided by contact fingers 603A-F provides a low-impedance ground path from the ICM into the PCB, and eliminates the need for portions of the ICM wrapper, which would otherwise provide a similar function. That is, the addition of contact fingers 603A-F increases the availability of an electrical ground connection between the PCB and the supported ICMs.

By eliminating portions of the ICM wrapper, the subject technology provides ICM grounding configurations that reduce manufacturing costs while maintaining safety compliance.

In yet another aspect, the CMC and ICM configurations of the subject technology provide PCB layout configurations that facilitate the placement of lights, such as LEDs, at symmetrical positions around the ICM. By way of example, an ICM of the subject technology may be flanked by LEDs, which are used to signal to an external operator or user, that a corresponding connection if the illuminated ICM is active. In some implementations, a light-pipe or tube can be used to transmit light from the surface of the PCB (where the LEDs are mounted), and an external surface of the case or enclosure, so that they are visible to the user.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more."

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

What is claimed is:

1. A common mode choke (CMC) component, comprising:

an upper chassis element comprising a first plurality of comb structures vertically protruding from an edge of the upper chassis element, and a lower chassis element comprising a second plurality of comb structures vertically protruding from an edge of the lower chassis element, the second plurality of comb structures configured to interlock with the first plurality of comb structures to form an enclosure when the upper chassis element is mechanically coupled with the lower chassis element, wherein the lower chassis element further comprises a plurality of pegs distending outward from the enclosure, the plurality of pegs configured to receive a respective toroid wire from a magnetic toroid disposed within the enclosure, and wherein each of the plurality of pegs comprises a wire cutting mechanism.

2. The CMC of claim 1, wherein a mechanical coupling between the upper chassis element and the lower chasses element forms a wire gap between an inside of the enclosure and an outside of the enclosure.

3. The CMC component of claim 1, wherein at least one of the plurality of pegs is an asymmetrical shape.

4. The CMC component of claim 1, wherein each of the plurality of pegs comprises a top surface and a bottom surface, and wherein the top surface is substantially flat relative to the bottom surface.

5. The CMC component of claim 1, wherein each of the respective toroid wires is received via a different wire gap.

6. The CMC component of claim 1, wherein the upper chassis element includes a clip configured to mechanically couple with the lower chassis element.

7. The CMC component of claim 1, further comprising:

a spring finger disposed on an inner surface of the upper chassis element, and wherein the spring finger is configured to restrain a toroid element in the enclosure by applying a mechanical force to the toroid element.

8. The CMC component of claim 1, wherein the enclosure is configured to hold two or more magnetic toroids.

9. The CMC component of claim 1, wherein the lower chassis element further comprises a divider to provide separation between two magnetic toroids disposed within the enclosure.

10. The CMC component of claim 1, wherein the upper chassis element and the lower chassis element are comprised of a high temperature plastic.

* * * * *